US010064506B2

(12) United States Patent
Coon et al.

(10) Patent No.: US 10,064,506 B2
(45) Date of Patent: Sep. 4, 2018

(54) SEALING MECHANISM FOR BEVERAGE CONTAINER

(71) Applicant: IGNITE USA, LLC, Chicago, IL (US)

(72) Inventors: Robert Coon, Chicago, IL (US); Paul Hurley, Libertyville, IL (US)

(73) Assignee: IGNITE USA, LLC, Chicago, IL (US)

( * ) Notice: Subject to any disclaimer, the term of this patent is extended or adjusted under 35 U.S.C. 154(b) by 0 days.

(21) Appl. No.: 15/384,259

(22) Filed: Dec. 19, 2016

(65) Prior Publication Data

US 2017/0099969 A1 Apr. 13, 2017

Related U.S. Application Data

(63) Continuation of application No. 14/573,506, filed on Dec. 17, 2014, now Pat. No. 9,521,918.

(60) Provisional application No. 61/917,749, filed on Dec. 18, 2013.

(51) Int. Cl.

| | |
|---|---|
| ***B65D 47/24*** | (2006.01) |
| ***B65D 47/08*** | (2006.01) |
| ***B65D 45/02*** | (2006.01) |
| ***A47G 19/22*** | (2006.01) |
| ***B65D 55/02*** | (2006.01) |
| ***B65D 51/16*** | (2006.01) |
| ***B65D 43/16*** | (2006.01) |

(52) U.S. Cl.

CPC ..... *A47G 19/2272* (2013.01); *B65D 43/16* (2013.01); *B65D 51/1672* (2013.01); *B65D 55/02* (2013.01)

(58) Field of Classification Search

CPC .. B65D 47/024; B65D 47/241; B65D 47/245; B65D 47/248; B65D 47/249; B65D 47/2006; B65D 45/025

See application file for complete search history.

(56) References Cited

U.S. PATENT DOCUMENTS

| | | | |
|---|---|---|---|
| 694,932 | A | 3/1902 | Abbee et al. |
| 3,675,685 | A | 7/1972 | Potter |
| 3,739,938 | A | 6/1973 | Paz |
| 3,964,631 | A | 6/1976 | Albert |
| 4,133,446 | A | 1/1979 | Albert |
| 4,212,408 | A | 7/1980 | Valenzona |
| 4,558,806 | A | 12/1985 | Shabram, Sr. et al. |

(Continued)

FOREIGN PATENT DOCUMENTS

WO WO-2002081322 A1 10/2002

OTHER PUBLICATIONS http://www.Keurig.com/~/media/Files/Manuals/Keurig-SS-Travel-Mug.ashx at least as early as Nov. 19, 2013.

(Continued)

*Primary Examiner* — Andrew T Kirsch

(74) *Attorney, Agent, or Firm* — Marshall, Gerstein & Borun LLP

(57) ABSTRACT

An openable and closeable lid assembly is provided for a beverage container. The lid assembly comprises a lid housing, an actuator and a seal. The lid housing has an upper surface with a drink aperture and an actuator aperture extending therethrough. The actuator extends through the actuator aperture and is positionable in an open position, where liquid can pass through the drink aperture, and a closed position, where the drink aperture is closed. A seal is provided adjacent the actuator aperture. The seal seals against the actuator and the lid housing to prevent liquid from escaping out the actuator aperture.

17 Claims, 5 Drawing Sheets

(56) References Cited

U.S. PATENT DOCUMENTS

| | | | |
|---|---|---|---|
| 4,712,704 | A | 12/1987 | Ramsey et al. |
| 5,242,079 | A | 9/1993 | Stephens et al. |
| 5,797,523 | A | 8/1998 | Gross |
| 6,352,166 | B1 | 3/2002 | Copeland |
| 6,763,964 | B1 | 7/2004 | Hurlbut et al. |
| 7,780,046 | B1 | 8/2010 | Lowe |
| 8,550,280 | B2 | 10/2013 | Steuer |
| 8,584,878 | B2 | 11/2013 | McDowell |
| 2006/0226160 | A1 | 10/2006 | Elsaden et al. |
| 2007/0164026 | A1 | 7/2007 | Morrissey et al. |
| 2011/0315684 | A1 | 12/2011 | Bratsch |
| 2012/0103987 | A1 | 5/2012 | Lucas |
| 2012/0145712 | A1 | 6/2012 | Bratsch |
| 2012/0325815 | A1 | 12/2012 | Gilbert et al. |
| 2013/0062358 | A1 | 3/2013 | El-Saden et al. |

OTHER PUBLICATIONS

International Search Report and Written Opinion for related International Application No. PCT/US2014/070855, dated Apr. 1, 2015.
First Office Action, Chinese patent application No. 201480073159.4, dated Jun. 19, 2017.

SEALING MECHANISM FOR BEVERAGE CONTAINER

CROSS-REFERENCE TO RELATED APPLICATIONS

This application is a continuation of U.S. patent application Ser. No. 14/573,506, filed Dec. 17, 2014, which claims priority to priority to U.S. Provisional Patent Application No. 61/917,749, filed Dec. 18, 2013, which is incorporated herein by reference in its entirety and made a part hereof.

FEDERALLY SPONSORED RESEARCH OR DEVELOPMENT

Not Applicable.

TECHNICAL FIELD

The present invention relates generally to a beverage container, and more specifically to a sealing mechanism for a beverage container.

BACKGROUND OF THE INVENTION

Beverage containers and lids with sealing mechanisms for beverage containers, including beverage containers with lids having drink and vent openings, are known in the art. Traditionally, sealing mechanisms for such beverage container lids are releasable by exerting a force on a hinged member, typically a member that lifts upward to provide access to a drink opening (e.g., fluid hole or strawlike member). While such beverage containers and sealing mechanisms according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

According to one embodiment, the disclosed subject technology relates to a lid assembly for a beverage container, where the lid assembly has an actuator to open and close a drink aperture in the lid housing.

The disclosed subject technology further relates to a lid assembly having a lid housing, an actuator that extends through an aperture in the upper surface of the lid housing, and a seal adjacent the actuator aperture. The seal seals against the actuator and the lid housing to prevent liquid from escaping out the actuator aperture.

The disclosed subject technology further relates to a lid housing having an upper surface, a drink aperture extending through the upper surface of the lid housing, and an actuator aperture extending through the upper surface lid housing.

The disclosed subject technology further relates to a vent aperture extending through the upper surface of the lid.

The disclosed subject technology further relates to the actuator extending through the actuator aperture in the lid housing and positionable in an open position where liquid can pass through the drink aperture, and a closed position where the drink aperture is closed. In one embodiment, the actuator has a first end and a second end. The first end is positioned below the upper surface in both the open position and the closed position of the actuator. The first end may have a drink seal for closing the drink aperture. The second end is positioned above the upper surface in both the open position and the closed position, and the second end is adapted to be engaged by an operator to reposition the actuator in one of the open position and the closed position.

The disclosed subject technology further relates to an actuator having a ball joint between the first end and the second end, and wherein the seal seals against the ball joint and the lid housing to prevent liquid from escaping out the actuator aperture.

The disclosed subject technology further relates to a pivot member extending from the actuator. The pivot member is received in a receiver in the lid housing and is pivotable about a pivot axis within the receiver, wherein the pivot axis is transverse to a longitudinal axis of the beverage container.

The disclosed subject technology further relates to a vent aperture in the lid housing. The vent aperture is preferably open when the actuator is in the open position, and the vent aperture is preferably closed when the actuator is in the closed position.

The disclosed subject technology further relates to the lid assembly having a lock to secure the actuator in the closed position.

The disclosed subject technology further relates to a drink seal that is connected adjacent the drink aperture and not on the actuator. In one embodiment, the first end of the actuator engages the drink seal to close the drink aperture.

The disclosed subject technology further relates to a lid assembly for a beverage container, comprising a lid housing having an upper surface, a drink aperture extending through the upper surface of the lid housing, and an actuator aperture extending through the upper surface lid housing. The actuator has a first section and a second section. The first section has a drink seal for closing the drink aperture. The actuator has a ball joint between the first section and the second section, and the actuator is moveable between an open position where liquid can pass through the drink aperture and a closed position where the drink aperture is closed. A seal is provided adjacent the actuator aperture, and the seal seals against the ball joint and the lid housing to prevent liquid from escaping between the ball joint and the lid housing.

The disclosed subject technology further relates to the lid housing having a vent aperture, and wherein the actuator has a vent plug that seals the vent aperture when the actuator is in the closed position. In one embodiment, the vent plug is positioned above the upper surface.

The disclosed subject technology further relates to a lid assembly where the drink seal is located below the upper surface, and where the drink seal drops below the drink aperture when the actuator is in the open position to open the drink aperture.

The disclosed subject technology further relates to a lid assembly where the first and second sections of the actuator are separate elements connected together.

The disclosed subject technology further relates to a lid assembly for a beverage container, comprising a lid housing having an upper surface, a drink aperture extending through the upper surface of the lid housing, an actuator aperture extending through the upper surface lid housing, and a vent aperture extending through the upper surface of the lid housing. In one embodiment, an actuator extends through the actuator aperture and has a first end and a second end. The actuator is moveable between an open position, where liquid can pass through the drink aperture, and a closed position, where the first end of the actuator engages the drink aperture to close the drink aperture. The lid assembly also preferably has a seal adjacent the actuator aperture, the seal sealing against the actuator and the lid housing to prevent liquid from escaping out the actuator aperture.

The disclosed subject technology further relates to a lid assembly where the actuator has a vent plug that seals the vent aperture when the actuator is in the closed position.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example only, not by way of limitation, with reference to the accompanying drawings in which embodiments of the disclosures are illustrated and, together with the descriptions below, serve to explain the principles of the disclosure.

DETAILED DESCRIPTION

Figure 1:
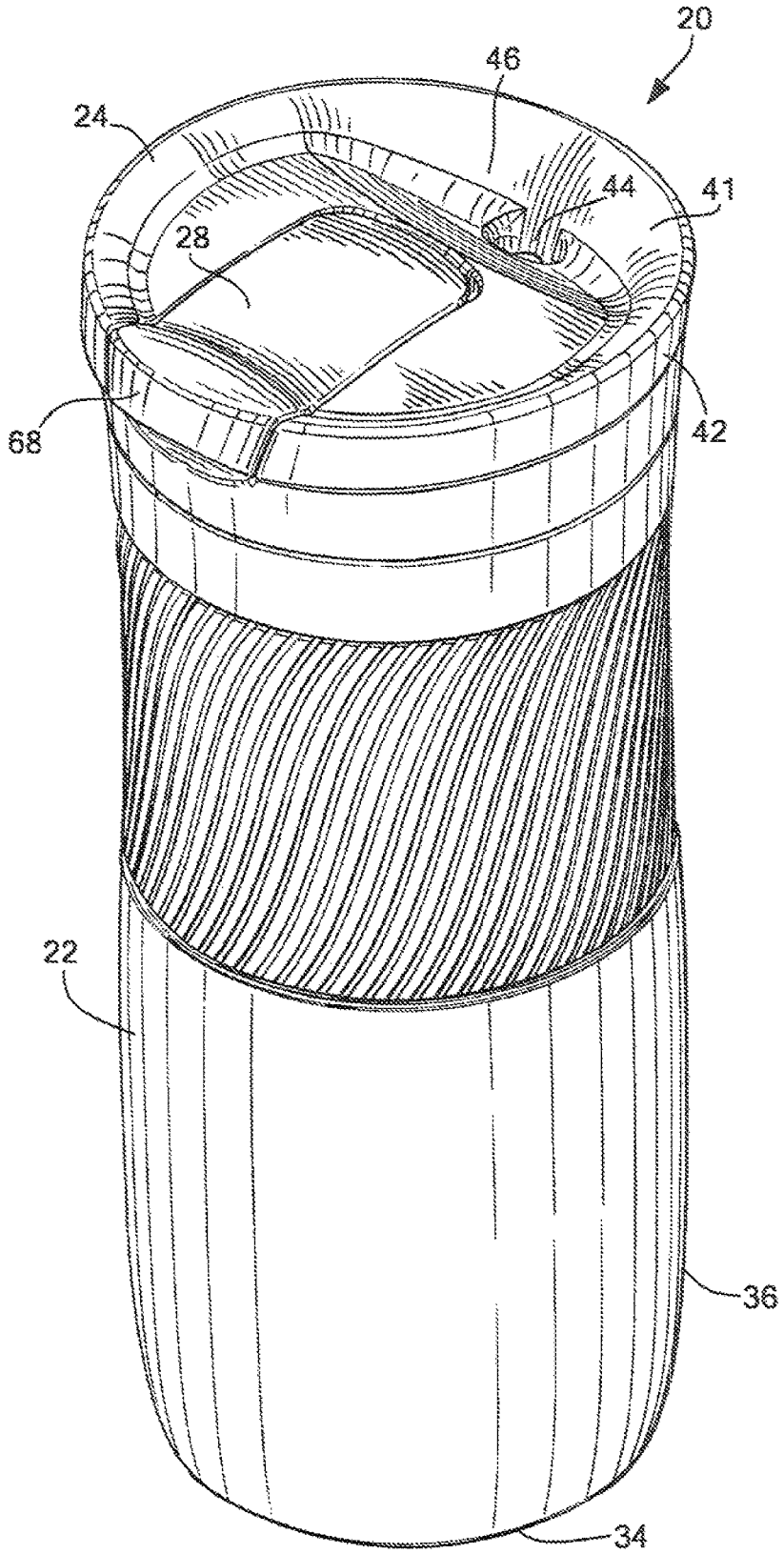
FIG. 1 is a perspective view of one example of a beverage container with a sealing assembly in the sealed position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 3:
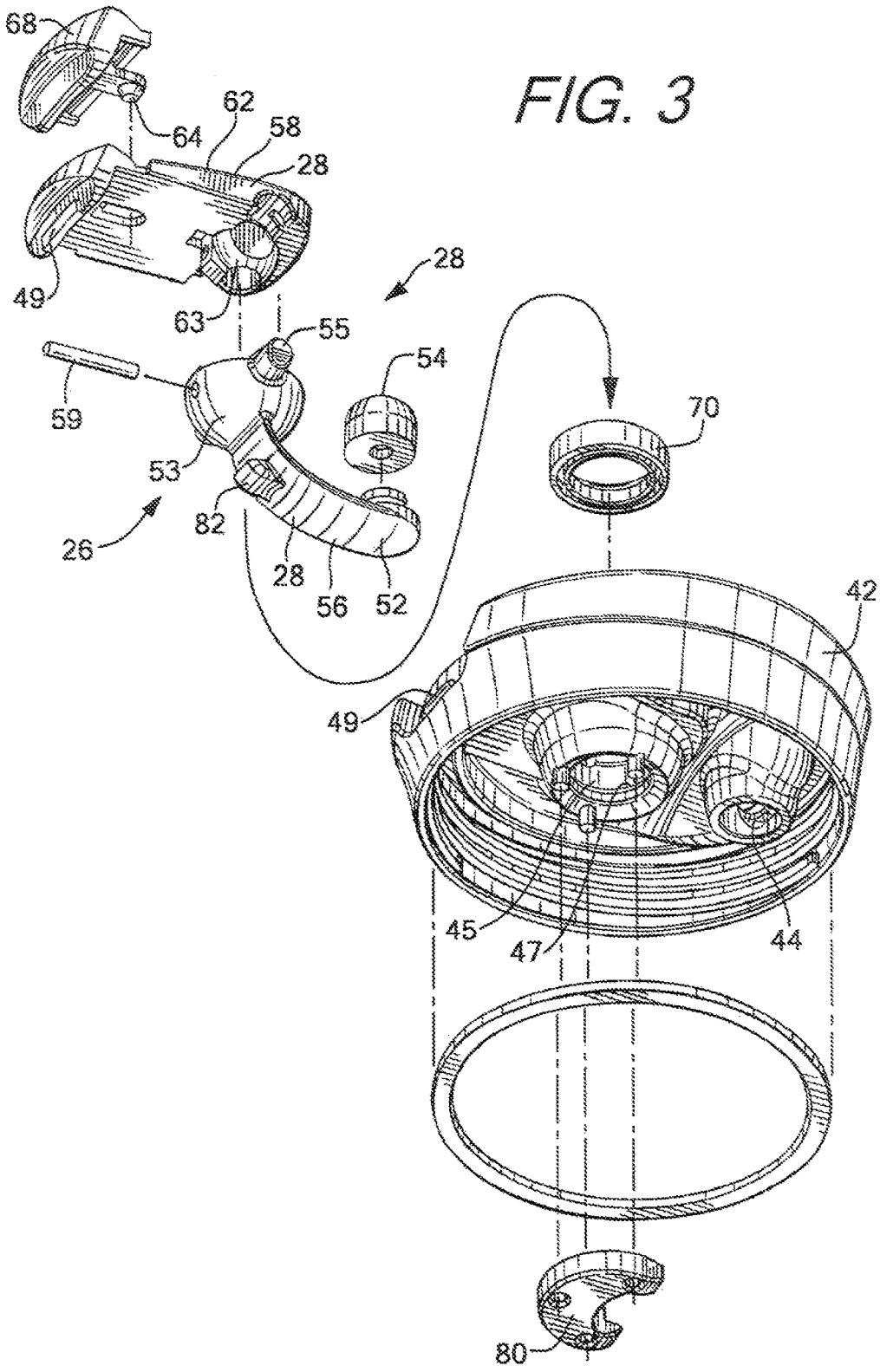
FIG. 3 is an exploded view of the beverage container of FIG. 1.

Referring now to the figures, and specifically to FIGS. 1 and 3, there is shown a beverage container 20 generally comprising a container body 22, a lid assembly 24 and a sealing assembly 26. The lid assembly may be connected to the container body 22 by threading, pressure fitting or the like. In one embodiment, the lid assembly 24 is configured to receive or include the sealing assembly 26. The sealing assembly 26 in one example preferably includes an actuator member 28, also referred to herein as an actuator 28 and a seal actuator member 28. The actuator 28 is used to open and close a drink aperture 44 for drinking from the beverage container 20.

In one embodiment the container body 22 comprises a side wall member 32, a bottom member 34 toward a distal end 36 of the side wall member 32, and a liquid retaining cavity 38 therebetween. The container body 22 may be comprised of a single wall member formed from any suitable material such as metal, plastic or the like. Alternatively, the container body 22 may comprise a two-part construction of an inner wall member and an outer wall member to provide an insulating feature. The area between the inner and outer wall members may empty, may be filled with an insulating material or may be under vacuum to provide a better thermal barrier for hot and cold items in the cavity 38.

The lid assembly 24 has a base 42 or lid housing 42, and the lid housing 42 preferably has an upper surface 41. In one embodiment a fluid well 46 is formed as part of the upper surface 41 of the lid housing 42 adjacent a perimeter of the lid housing 42. A drink aperture 44 that extends through the upper surface 41 of the lid housing 42 may be provided in the fluid well 46. Positioning the fluid well 46 and the drink aperture 44 near the perimeter of the lid housing 42 allows the user to drink directly from the beverage container 20 or to pour liquid from the beverage container 20. The drink aperture 44 and fluid well 46 may be sized and shaped to allow for liquid to be poured out of the beverage container 20 and for excess liquid in the fluid well 46 to drain back into the beverage container 20. Additionally, the fluid well 46 may allow users to slurp liquid, such as hot liquid, that is dispensed out of the drink aperture 44. Alternately, the lid housing 42 may not include a fluid well 46, which allows the user to drink directly from the drink aperture 44.

Figure 6:
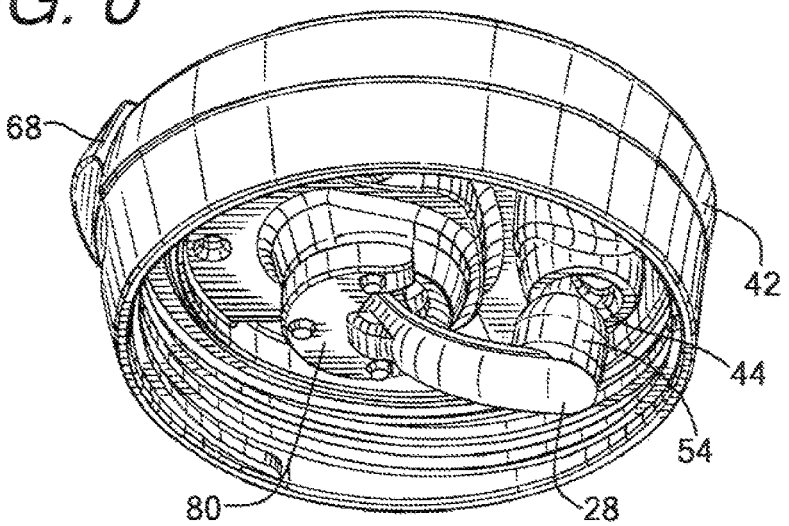
FIG. 6 is a bottom perspective view of one embodiment of a lid for a beverage container, with the sealing assembly in the open position.

As explained above, the actuator 28 is used to open and close the drink aperture 44. Accordingly, the actuator 28 is positionable in an open position (see FIGS. 4-6) and a closed position (see FIGS. 1 and 2). In the open position liquid can pass from the liquid retaining cavity 38 in the container body 22 and through the drink aperture 44 for drinking by the user, and in the closed position the liquid cannot pass through the drink aperture 44 because the drink aperture 44 is sealed.

In one embodiment, the lid housing 42 also has a vent aperture 48. The vent aperture 48 may be positioned near the perimeter of the lid housing 42 opposite from the drinking aperture 44. The vent aperture 48 may further be provided in the upper surface 41 of the lid housing 42. In one embodiment, the vent aperture 48 is generally open when the actuator 28 is in the open position and the drink aperture 44 is open, and the vent aperture 48 is generally closed when the actuator 28 is in the closed position and the drink aperture 44 is closed. The vent aperture 48 assists in providing a vent for the liquid retaining cavity 38 of the container body 30 to assist in providing smoother dispensing and drinking of the contents of the beverage container 20.

The lid housing 42 may also have a locking member 49 or lock 49 to retain the sealing assembly 26 in the closed position. In one embodiment, the lock 49 engages the actuator member 28 of the sealing assembly 26 and secures the actuator 28 in the closed position.

Figure 2:
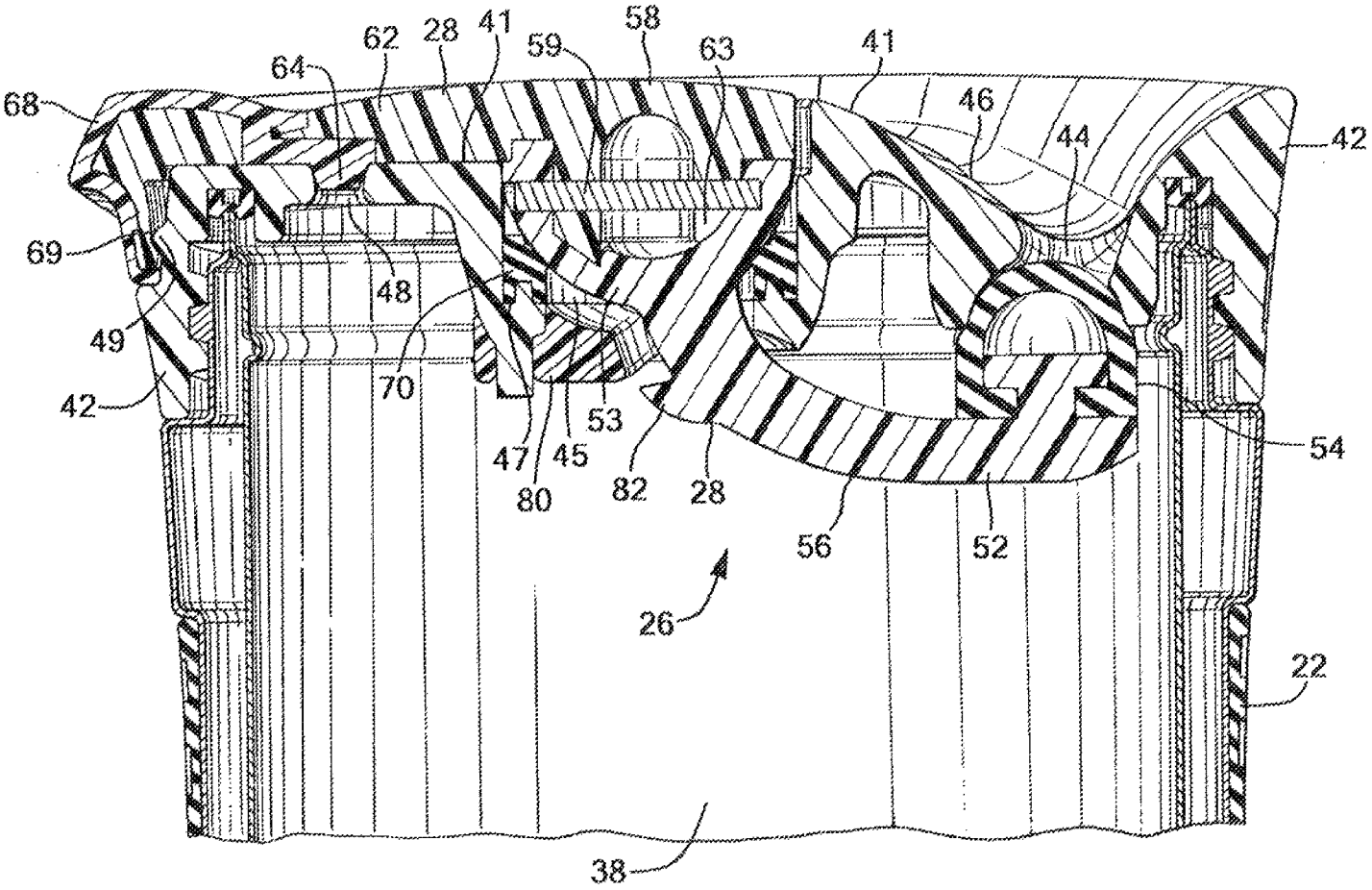
FIG. 2 is a cross-section side view of a portion of the beverage container of FIG. 1 with the sealing assembly in the closed position.
Figure 4:
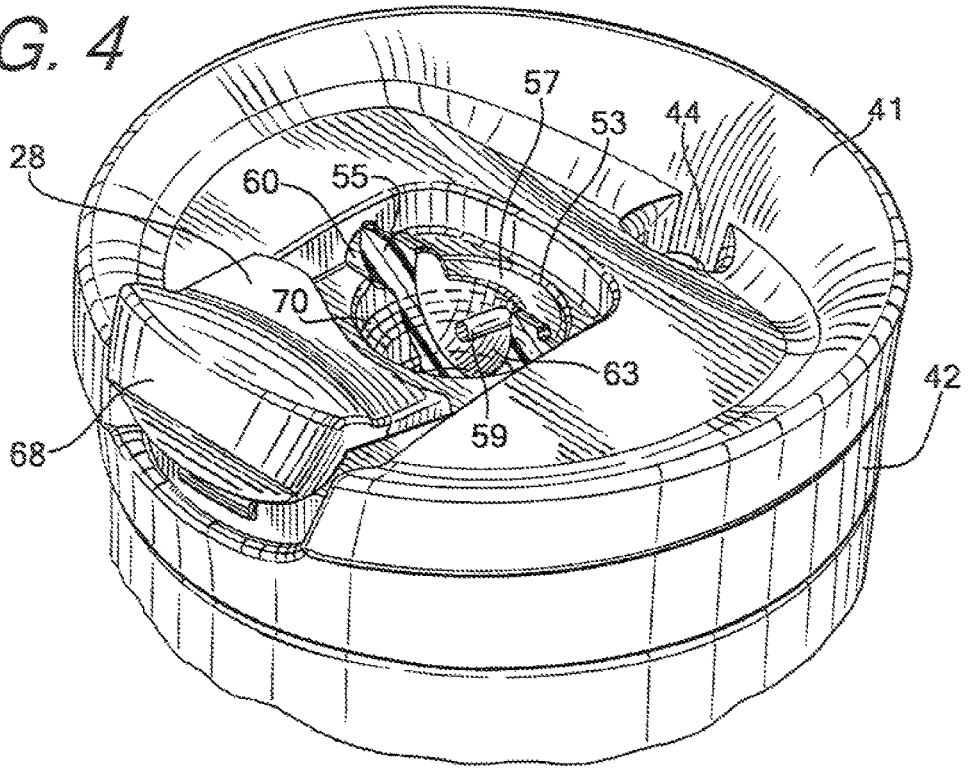
FIG. 4 is a top perspective view of one embodiment of a lid for a beverage container, with the sealing assembly in the open position.
Figure 5:
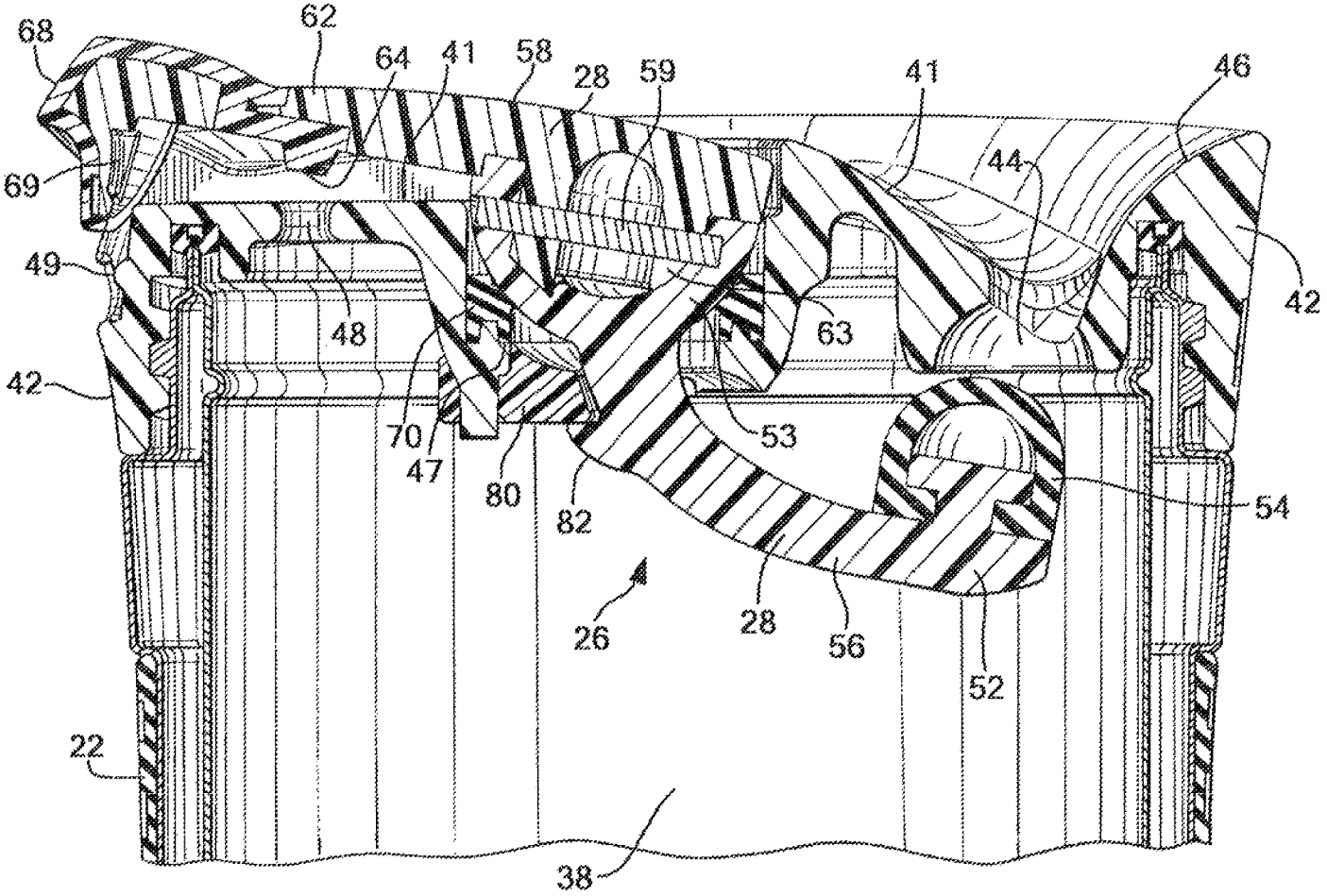
FIG. 5 is a cross-section side view of a portion of the beverage container of FIG. 1 with the sealing assembly in the open position.

The lid housing 42 preferably also has an actuator aperture 45 extending through the upper surface 41 of the lid housing 42. The actuator aperture 45 is sized and shaped to receive a portion of the sealing assembly 26. In one embodiment, as shown in FIGS. 2 and 4, an annular ledge 47 is provided as part of the lid housing 42 adjacent the actuator aperture 45. Preferably, the annular ledge 47 is provided concentric with the actuator aperture 45. In one embodiment, the annular ledge 47 supports a seal 70 for sealing the actuator 28. As shown in FIGS. 2 and 5, a portion of the sealing assembly 26, including a portion of the actuator member 28, passes through the actuator aperture 45, but another portion of the sealing assembly 26, including another portion of the actuator member 28, cannot pass through the actuator aperture 45 and is held in place against the seal 70 situated on the annular ledge 47 of the lid housing 42.

As best shown in FIGS. 2 and 5, the actuator member 28 of the sealing assembly 26 has a first end 52 and a second end 62. In one embodiment, the drink seal 54 is connected to the actuator member 28 at the first end 52 thereof for opening and closing the drink aperture 44. The first end 52 of the actuator member 28, including the drink seal 54, is positioned below the upper surface 41 of the lid housing 42 in both the open position and the closed position of the actuator 28, and the drink seal 54 drops below the drink aperture 44 when the actuator 28 is in the open position to open the drink aperture 44. The second end 62 of the actuator member 28 is generally positioned above the upper surface 41 of the lid housing 42 in both the open position and the closed position of the actuator 28. The second end 62 of the actuator 28 is adapted to be engaged by an operator to reposition the actuator 28 in one of the open position and the closed position for use of the beverage container 20. Additionally, in one embodiment the actuator member 28 has a ball joint 53 located between the first end 52 and the second end 62 of the actuator member 28. The ball joint 53 provides a sealing surface to seal the actuator member 28 to the lid housing 42 during all movement of the actuator member 28, including when the actuator member 28 is in the open position, closed position and in all positions therebetween. Thus, one benefit of the ball joint 53 is that a seal between the actuator member 28 and the lid housing 42 can be maintained at all times against the ball joint 53 when the actuator 28 is manipulated by the user.

In one embodiment, the actuator member 28 is made of two components that are fixed together, including a drinking aperture portion 56 (also referred to as a first section) and a vent aperture portion 58 (also referred to as a second section), although the actuator member 28 may alternately be made of one component that includes both the drinking aperture portion 56 and the vent aperture portion 58 integrally formed, such as by injection molding and the like. When the actuator member 28 is made of two components 56 and 58, in one embodiment the ball joint 53 may be part of the drinking aperture portion 56 of the actuator member 28 and is located at one end thereof, and the drink seal 54 is located at the opposing second end of the drinking aperture portion 56 of the actuator member 28. Further, in such an embodiment where the actuator 28 is made of multiple components, the vent aperture portion 58 of the actuator member 28 may have a first end that mates or engages with the ball joint end of the drinking aperture portion 56. For example, in the embodiment where the actuator member 28 is made of at least two components, the first end of the vent aperture portion 58 may have a protrusion 63 that is sized and shaped to mate with a cavity 57 of the ball joint 53. A pin 59 secures the protrusion 63 in the cavity 57 of the ball joint 53, joining the drinking aperture portion 56 and the vent aperture portion 58 together to create a single actuator member 28.

In a preferred embodiment, the actuator member 28 extends through the actuator aperture 45 in the lid housing 42 and is positionable in the open position where liquid can pass through the drink aperture 44, and a closed position where the drink aperture 44 is closed. The actuator member 28 preferably pivots between the open position and the closed position. As shown in FIGS. 3 and 4, in a preferred embodiment, the actuator member 28 has pivot members 55 extending from the actuator member 28 that are sized and shaped to be received by receivers 60 in the lid housing 42. In one embodiment the pivot members 55 are shaft-like members 55 extending from opposing sides of the actuator 28. The pivot members 55 define a pivot axis extending between the two pivot members 55, and in one embodiment the pivot axis is transverse to a longitudinal axis of the beverage container 10 when the lid housing 42 is secured to the beverage container body 22. The pivot members 55 are pivotable about the pivot axis. In one embodiment the receivers 60 comprise openings in the lid housing 42, such as bores, into which the pivot members 55 can be placed and in which the pivot members 55 can rotate or pivot. The pivot members 55 operate to allow the actuator member 28 to pivot about the axis of the pivot members 55, thereby providing for a seesaw motion of the actuator member 28 of the sealing assembly 26 between the open position and the closed position.

As best shown in FIGS. 2, 3 and 5, the drink seal 54 on the actuator 28 is sized and shaped to seal the drink aperture 44 when the sealing assembly 26 is in the sealed or closed position. Preferably, the drink seal 54 is made of a flexible material such as rubber, soft plastic and the like. The drink seal 54 may be a separate component that attaches to a protrusion at the first end 52 of the actuator 28 or it may be overmolded onto the first end 52 of the aperture 28, and the like. Alternately, the drink seal 54 may be secured to the base 42 of the lid assembly 24 adjacent the drink aperture 44 and not on the actuator 28, and the actuator member 28 may have a protrusion or bump that engages the drink seal 54 to close the drink aperture 44.

As shown in FIG. 3, the second end 62 of the actuator member 28 has a grip member 68 providing a gripping surface for a user to push/pull the sealing assembly 26 open and closed. The grip member 68 may be rubber, soft plastic and the like, which may be overmolded onto the actuator member 28, for example. The grip member 68 has a locking cavity 69 sized and shaped to receive the locking member 49 extending from the lid housing 42 to secure the actuator 28 in the closed position. The actuator member 28 also has a vent aperture seal 64, also referred to as a vent seal 64 or vent plug 64, sized and shaped to seal the vent aperture 48 when the sealing assembly 26 is in the sealed or closed position. Preferably, the vent seal 64 is made of a flexible material such as rubber, soft plastic and the like. Additionally, the vent plug 64 is preferably positioned above the upper surface 41 of the lid housing 42. Alternately, the vent seal 64 may be secured to the lid housing 42 of the lid assembly 24 adjacent the vent aperture 48, and the actuator member 28 may have a protrusion or bump that engages the vent aperture seal 64.

In one embodiment, the sealing assembly 26 has a ball joint seal 70 sized and shaped to be received within and adjacent the actuator aperture 45 and engage the annular ledge 47. The ball joint seal 70 may be an O-ring, a gasket and the like. The ball joint 53 of the actuator 28 is preferably seated on the ball joint seal 70, providing a liquid tight seal between the sealing assembly 26 and the actuator aperture 45 of the lid housing 42 to help prevent liquid in the container from escaping through the actuator aperture 45. The ball joint seal 70 is configured such that the ball joint 53 is sealingly engaged at any position in the operation of the sealing assembly 26. For example, the ball joint 53 pivots within the ball joint seal 70 as the sealing assembly 26 is moved between open and closed positions, the ball joint 53 maintaining sealable contact with the ball joint seal 70 at all times.

In operation, in one embodiment a user may put a thumb or finger on the grip member 68 at the second end 62 of the actuator member 28 and lift or push upwards to move the sealing assembly 26 into an open position. The upward force needs to be sufficient to cause the locking cavity 69 of the actuator member 28 to disengage from the locking member 49 of the lid housing 42 in a camming movement, as well as to overcome the friction fit between the ball joint 53 and the ball joint seal 70. The friction fit between the ball joint 53 and the ball joint seal 70, as well as the friction fit between the pivot members 55 and the receivers 60 in the base 42, may further act to keep the sealing assembly 26 in any given position unless an overriding force is applied to the sealing assembly 26. For example, when the sealing position 26 is in the open position, it is biased by the friction force to remain in the open position.

As the sealing assembly 26 pivots into the open position, in one embodiment the drink seal 54 and the vent seal/vent plug 64 are pulled away from a sealed engagement with the drink aperture 44 and the vent aperture 48 respectively. In a preferred embodiment, the actuator member 28 moves the drink seal 54 downwardly and into the cavity 38 of the beverage container 20. Conversely, in this embodiment the vent plug 64 moves upward and away from the upper surface 41 of the lid housing 42 in a teeter-totter style movement. In one embodiment, a stop 82 extends from the actuator member 28. The stop 82 engages a surface on the lid housing 42 to prevent further movement of the actuator member 28 in the opening direction. In one embodiment an extension 80 is connected to the bottom of the lid housing 42 to provide the surface to stop movement of the actuator member 28, however, in alternate embodiments the extension 80 is not provided.

To move the sealing assembly 26 to a closed position, the user pushes down on the grip member 68 at the second end 62 of the actuator member 28, causing the second end 62 of the actuator member 28 to pivot downwards toward the upper surface 41 of the lid housing 42 and seal the vent aperture 48, and also simultaneously causing the first end 52 of the actuator member 28 to pivot upwards toward the drink aperture 44 to close and seal the drink aperture 44. The downward force on the second end 62 of the actuator member 28 needs to be sufficient to cause the locking cavity 69 to ride down on and engage the locking member 49 in a camming movement, as well as to overcome the friction fit between the ball joint 53 and the ball joint seal 70.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lid assembly for a beverage container, comprising:

a lid housing having an upper surface, a drink aperture extending through the upper surface of the lid housing, and an actuator aperture extending through the upper surface of the lid housing;

an actuator extending through the actuator aperture in the lid housing and positionable in an open position where liquid can pass through the drink aperture and a closed position where the drink aperture is closed, the actuator having a first end, a second end, and a ball joint between the first end and the second end, the first end positioned below the upper surface in both the open position and the closed position of the actuator, and the first end having a drink seal for closing the drink aperture, the second end positioned above the upper surface in both the open position and the closed position, and the second end adapted to be engaged by an operator to reposition the actuator in one of the open position and the closed position; and, a seal within and adjacent the actuator aperture, the ball joint being seated on the seal, the seal sealing against the ball joint and the lid housing to prevent liquid from escaping out the actuator aperture both when the actuator is in the open position and when the actuator is in the closed position.

2. The lid assembly of claim 1, further comprising a vent aperture in the lid housing, the vent aperture being open when the actuator is in the open position, and the vent aperture being closed when the actuator is in the closed position.

3. The lid assembly of claim 1, further comprising a pivot member extending from the actuator, the pivot member being received in a receiver in the lid housing and pivotable about a pivot axis within the receiver, the pivot axis being transverse to a longitudinal axis of the beverage container.

4. The lid assembly of claim 1, further comprising a lock to secure the actuator in the closed position.

5. A lid assembly for a beverage container, comprising:

a lid housing having an upper surface, a drink aperture extending through the upper surface of the lid housing, and an actuator aperture extending through the upper surface of the lid housing;

an actuator having a first section and a second section, the first section having drink seal for closing the drink aperture, the actuator further having a ball joint between the first section and the second section, the actuator moveable between an open position where liquid can pass through the drink aperture and a closed position where the drink aperture is closed; and, a seal within and adjacent the actuator aperture, the ball joint being seated on the seal, the seal sealing against the ball joint and the lid housing to prevent liquid from escaping between the ball joint and the lid housing both when the actuator is in the open position and when the actuator is in the closed position.

6. The lid assembly of claim 5, wherein the lid housing has a vent aperture, and wherein the actuator has a vent plug that seals the vent aperture when the actuator is in the closed position.

7. The lid assembly of claim 6, wherein the vent plug is positioned above the upper surface.

8. The lid assembly of claim 5, further comprising a pivot member extending from the actuator, the pivot member being received in a receiver in the lid housing and pivotable about a pivot axis within the receiver, the pivot axis being transverse to a longitudinal axis of the beverage container.

9. The lid assembly of claim 5, wherein the actuator extends through the actuator aperture in the lid.

10. The lid assembly of claim 5, wherein the drink seal is located below the upper surface, and wherein the drink seal drops below the drink aperture when the actuator is in the open position to open the drink aperture.

11. The lid assembly of claim 5, further comprising a lock to secure the actuator in the closed position.

12. The lid assembly of claim 5, wherein the drink seal is connected adjacent the drink aperture and not on the actuator, and wherein the first end of the actuator engages the drink seal to close the drink aperture.

13. The lid assembly of claim 5, wherein the first and second sections of the actuator are separate elements connected together.

14. A lid assembly for a beverage container, comprising:

a lid housing having an upper surface, a drink aperture extending through the upper surface of the lid housing, an actuator aperture extending through the upper surface of the lid housing, and a vent aperture extending through the upper surface of the lid housing;

an actuator extending through the actuator aperture and having a first end and a second end, the actuator further having a ball joint between the first end and the second end, the actuator moveable between an open position where liquid can pass through the drink aperture and a closed position where the first end of the actuator engages the drink aperture to close the drink aperture; and, a seal within and adjacent the actuator aperture, the ball joint being seated on the seal, the seal sealing against the ball joint and the lid housing to prevent liquid from escaping out the actuator aperture both when the actuator is in the open position and when the actuator is in the closed position.

15. The lid assembly of claim 14, wherein the actuator has a vent plug that seals the vent aperture when the actuator is in the closed position.

16. The lid assembly of claim 14, further comprising a drink seal for closing the drink aperture, the drink seal connected to the first end of the actuator.

17. The lid assembly of claim 14, further comprising a pivot member extending from the actuator, the pivot member being received in a receiver in the lid housing and pivotable about a pivot axis within the receiver, the pivot axis being transverse to a longitudinal axis of the beverage container.

* * * * *